US007306433B2

(12) United States Patent
Klingels et al.

(10) Patent No.: US 7,306,433 B2
(45) **Date of Patent: *Dec. 11, 2007**

(54) APPARATUS AND METHOD FOR SECURING A ROTOR BLADE IN A ROTOR OF A TURBINE-TYPE MACHINE

(75) Inventors: Hermann Klingels, Dachau (DE); Klaus-Peter Rued, Groebenzell (DE)

(73) Assignee: MTU Aero Engines GmbH, Munich (DE)

( * ) Notice: Subject to any disclaimer, the term of this patent is extended or adjusted under 35 U.S.C. 154(b) by 0 days.

This patent is subject to a terminal disclaimer.

(21) Appl. No.: 11/413,753

(22) Filed: Apr. 28, 2006

(65) Prior Publication Data

US 2007/0059181 A1 Mar. 15, 2007

Related U.S. Application Data

(63) Continuation-in-part of application No. 11/339,219, filed on Jan. 25, 2006.

(30) Foreign Application Priority Data

Jan. 26, 2005 (DE) ..... 10 2005 003 511

(51) Int. Cl.
*F01D 5/30* (2006.01)

(52) U.S. Cl. ..... 416/216; 416/218; 416/220 R; 416/234

(58) Field of Classification Search ..... 416/215, 416/216, 217, 218, 220 R, 222, 234
See application file for complete search history.

(56) References Cited

U.S. PATENT DOCUMENTS

| | | | | | |
|---|---|---|---|---|---|
| 747,523 | A | * | 12/1903 | Wilkinson | 416/193 R |
| 1,345,678 | A | * | 7/1920 | Kasley | 416/218 |
| 1,347,327 | A | * | 7/1920 | Dickinson | 416/217 |
| 1,366,592 | A | * | 1/1921 | Pentheny et al. | 416/216 |
| 1,466,324 | A | * | 8/1923 | Wilkinson | 416/215 |
| 1,640,451 | A | * | 8/1927 | Junggren | 416/215 |
| 5,330,324 | A | * | 7/1994 | Agram et al. | 416/220 R |

* cited by examiner

*Primary Examiner*—Edward K. Look
*Assistant Examiner*—Nathan Wiehe
(74) *Attorney, Agent, or Firm*—Crowell & Moring LLP

(57) ABSTRACT

A rotor of a turbine-type machine, in particular a gas turbine rotor, is disclosed. The rotor has a rotor base body, where the rotor base body has a groove extending in the circumferential direction of the rotor base body, and has multiple rotor blades, or rotor blade segments, or an integrally bladed, circumferentially closed rotor blade ring. The rotor blades, or rotor blade segments, or rotor blade ring are/is anchored in the groove extending in the circumferential direction of the rotor base body by a blade base or ring base. The groove has a profiled groove wall leg on only one side, with the blade base of the rotor blades or the rotor blade segments, or ring base of the rotor blade ring, being in contact with the profiled groove wall leg with a correspondingly profiled supporting flank.

20 Claims, 10 Drawing Sheets

APPARATUS AND METHOD FOR SECURING A ROTOR BLADE IN A ROTOR OF A TURBINE-TYPE MACHINE

This application is a continuation-in-part of application Ser. No. 11/339,219, filed Jan. 25, 2006.

BACKGROUND AND SUMMARY OF THE INVENTION

The present invention relates to a rotor of a turbine-type machine, in particular a gas turbine rotor.

Rotors of turbine-type machines such as gas turbine rotors have a rotor base body and multiple rotor blades rotating with the rotor base body. These rotor blades may be an integral part of the rotor base body or they may be anchored via blade bases in one or more grooves in the rotor base body. Rotors having integral blading are referred to by the terms blisk or bling depending on whether they have a disk-shaped rotor base body or a ring-shaped rotor base body. In the case of rotors in which the rotor blades are anchored in a groove via blade bases, a distinction is made between rotors in which the blade bases of the rotor blades are secured either in so-called axial grooves of the rotor base body or in a circumferential groove of the same. The present invention here relates to a rotor of a turbine-type machine, in particular a gas turbine rotor, in which the rotor blades are mounted via their blade bases in a groove in the rotor base body running in the circumferential direction, i.e., a circumferential groove.

In rotors in which the rotor blades are attached with their blade bases in so-called circumferential grooves, the circumferential grooves have at least two filling openings distributed over the circumference so that the blade bases of the rotor blades can be inserted into the proper circumferential groove. The filling openings are formed according to the state of the art by constrictions in the area of two opposing profiled groove wall legs of the circumferential groove, whereby during operation, the blade bases are in contact with the two profiled groove wall legs. Notch points formed by the filling openings on sections of the groove wall legs are exposed to a relatively high level of stress during operation of the rotor. This reduces the lifetime of the rotor. In addition, owing to the above design principle of rotor blades guided in circumferential grooves according to the state of the art, the blade bases of the rotor blades have only approximately half the width in comparison with blade platforms of rotor blades as seen in the circumferential direction because of the above design principle of rotor blades guided in circumferential grooves. This also limits the forces that can be absorbed by the blade bases during operation of the rotor.

Against this background, the problem on which the present invention is based is creating a novel rotor of a turbine-type machine.

According to this invention, the groove has a profiled groove wall leg on only one side, the blade base(s) of the rotor blades, the blade segments, or the blade ring coming in contact with corresponding profile supporting flank(s) against this profile groove wall leg.

In the sense of the present invention, a rotor of a turbine-type machine is provided in which the rotor blades and/or rotor blade segments and/or rotor blade ring are/is anchored in a circumferential groove, whereby the circumferential groove has a profiled groove wall leg with the blade base(s) being in contact with the groove wall leg with a corresponding profile supporting flank(s) on only one side. This makes it possible to eliminate filling openings which in the state of the art are exposed to a relatively high stress level during operation of the rotor on sections of the grooved wall leg. In this way the rotor can be exposed to higher loads on the whole. In addition, the inventive design principle permits a method of anchoring rotor blade segments having a plurality of blade bases, or a rotor blade ring having a ring base, in a circumferential groove on a rotor in a manner that is optimized in terms of both stress and weight. In the case of rotor blades having outer cover bands, a so-called Z latching may be omitted, thus greatly simplifying the assembly of the rotor. The inventive design principle of a rotor allows inexpensive manufacture and easy assembly of rotors, thus yielding cost advantages in comparison with the state of the art.

The ring base of the rotor blade ring or the blade bases of the rotor blades or the rotor blade segments preferably have at least one projection on at least two different diameters, whereby the projections secure the base(s) in the groove in their axial position on the one hand and in a form-fitting manner to prevent tilting on the other hand. At least one securing element cooperates with projections on the base(s), whereby the securing element or each securing element secures the blade ring, rotor blades or the rotor blade segments in a form-fitting manner in its circumferential position in the groove.

Preferred refinements of this invention are derived from the following description. Exemplary embodiments of this invention are illustrated in greater detail with reference to the drawings without being limited to them.

DETAILED DESCRIPTION OF THE DRAWINGS

Before describing the present invention in greater detail below with reference to FIGS. 2 through 9, a gas turbine rotor known from the state of the art with the rotor blades guided in a circumferential groove will first be described with reference to FIG. 1.

Figure 1:
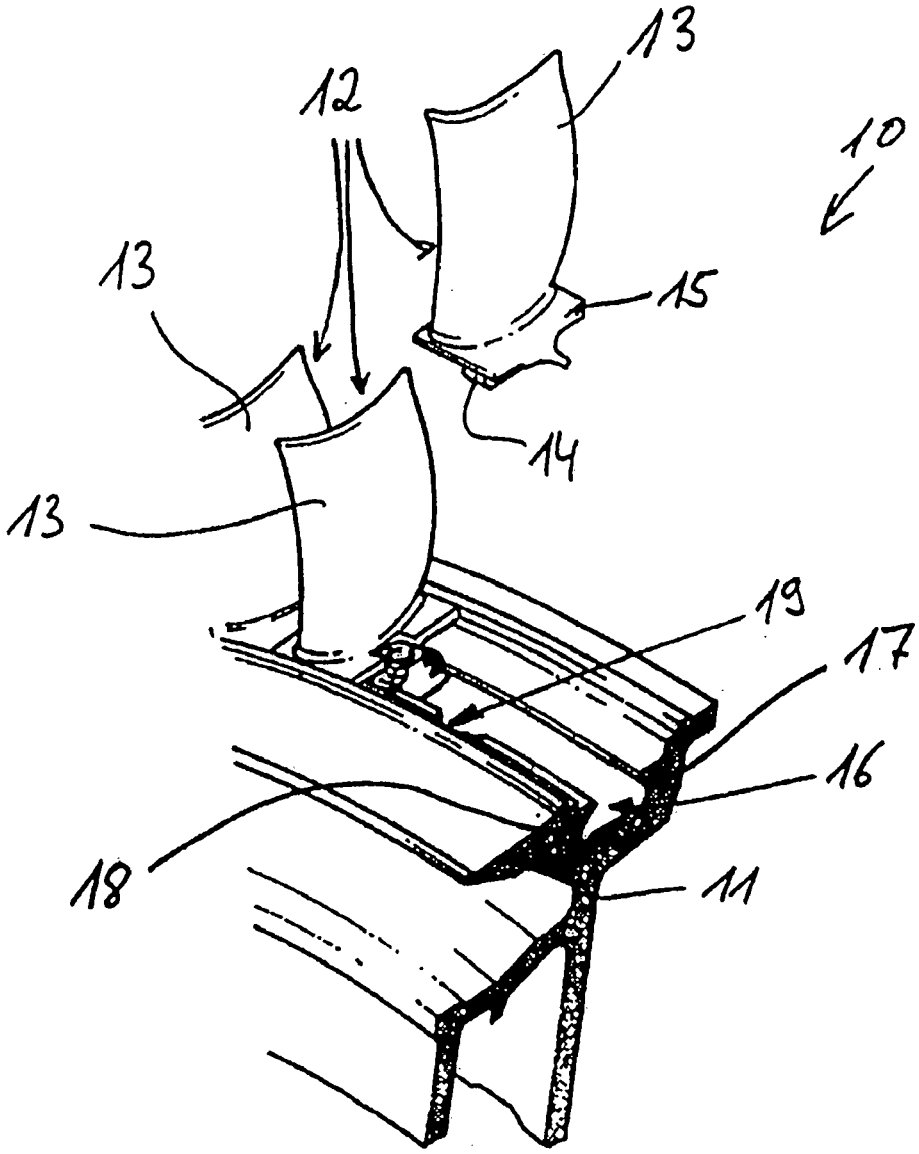
FIG. 1 PRIOR ART
FIG. 1 is a detail of a gas turbine rotor according to the state of the art in a perspective side view.

FIG. 1 shows a detail of a gas turbine rotor 10 according to the state of the art, where the gas turbine rotor 10 is formed by a rotor base body 11 and multiple rotor blades 12. According to FIG. 1, the rotor blades 12 each have a blade 13 and a blade base 14, whereby a blade platform 15 is formed between the blade 13 and the blade base 14. The rotor blades 12 are secured and are guided in a groove 16 extending in the circumferential direction on the rotor base body 11 via their blade bases 14.

As FIG. 1 indicates, the groove 16 which extends in the circumferential direction is open on the outside radially and is bordered by two profiled groove wall legs 17 and/or 18 which are opposite one another. To be able to insert the rotor blades 12 into the circumferential groove 16 via their blade bases 14, according to the state of the art, recesses and/or notches 19 forming filling openings for the blade bases 14 are formed in the groove 16 and/or the groove wall legs 17, 18. The notches 19 are formed in sections of the groove wall legs 17, 18 which are exposed to a relatively high stress level during operation of the gas turbine rotor 10. To be able to insert the rotor blades 12 into the circumferential groove 16, the rotor blades 12 are threaded into the circumferential groove 16 via their blade bases 14 in the area of the notches 19 and then are displaced in the circumferential direction. After the last rotor blade 12 has been inserted in the base of the gas turbine rotor 10 known from the state of the art according to FIG. 1, the entire set of rotor blades 12 is displaced by half a blade pitch in the circumferential direction so that all contact faces of the blade bases 14 are situated beneath the load-bearing groove wall legs 17 and 18 and thus are not in the area of a recess and/or a notch 19 in the groove wall legs 17, 18. It follows directly from this that the blade bases 14 have only approximately half the width of the blade platforms 15 as seen in the circumferential direction.

Figure 2:
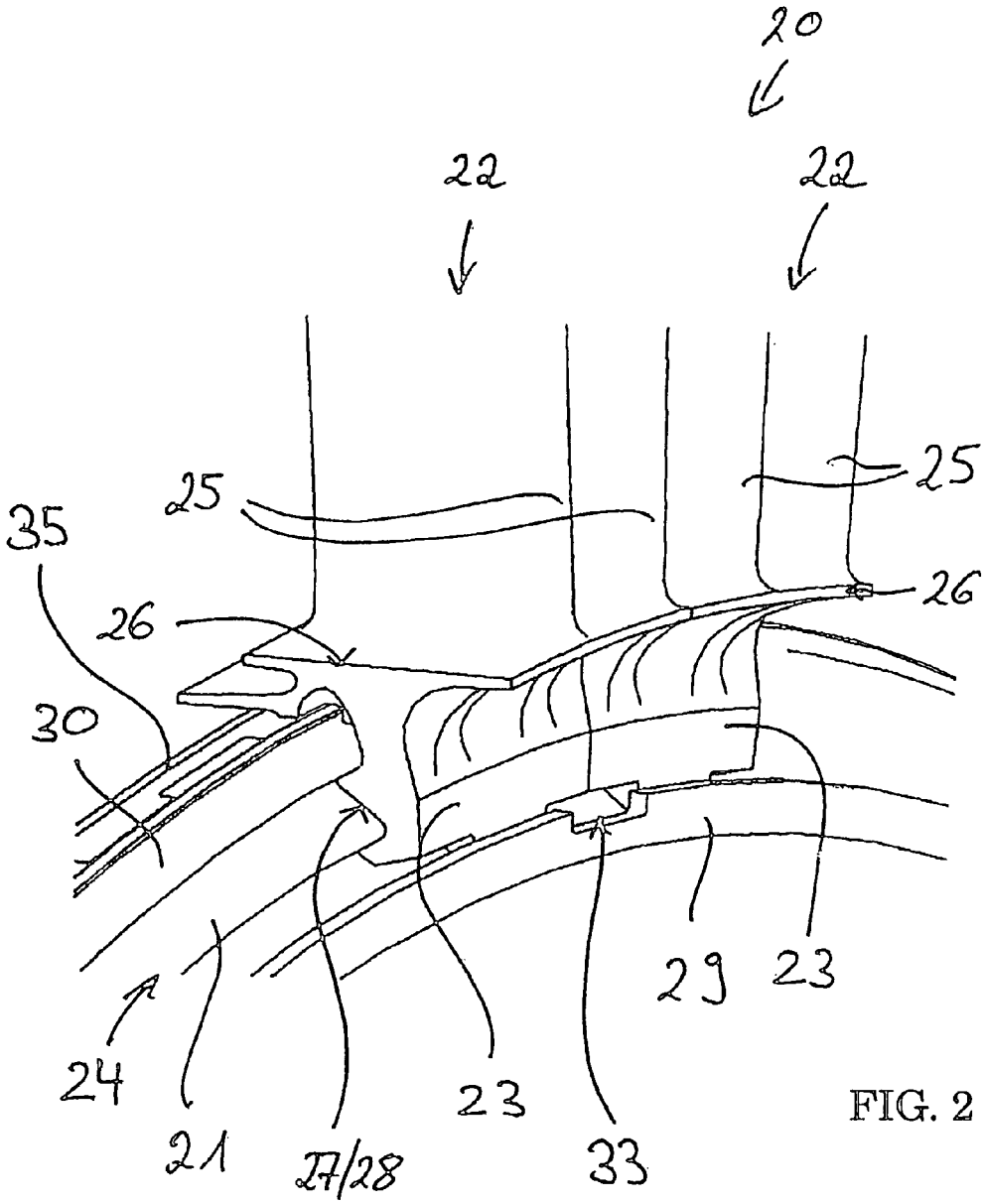
FIG. 2 is a detail of an inventive gas turbine rotor according to a first exemplary embodiment of the invention in a perspective side view.
Figure 6A:
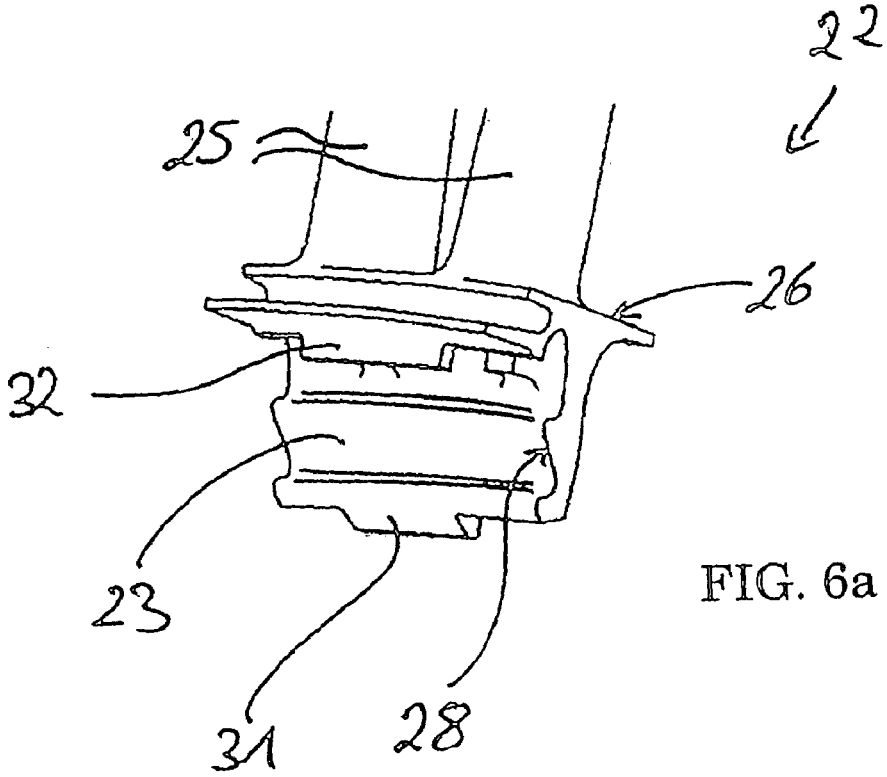
FIGS. 6*a* and 6*b* illustrate the rotor blade segment of the inventive gas turbine rotor of FIG. 2 in a perspective side view.
Figure 6B:
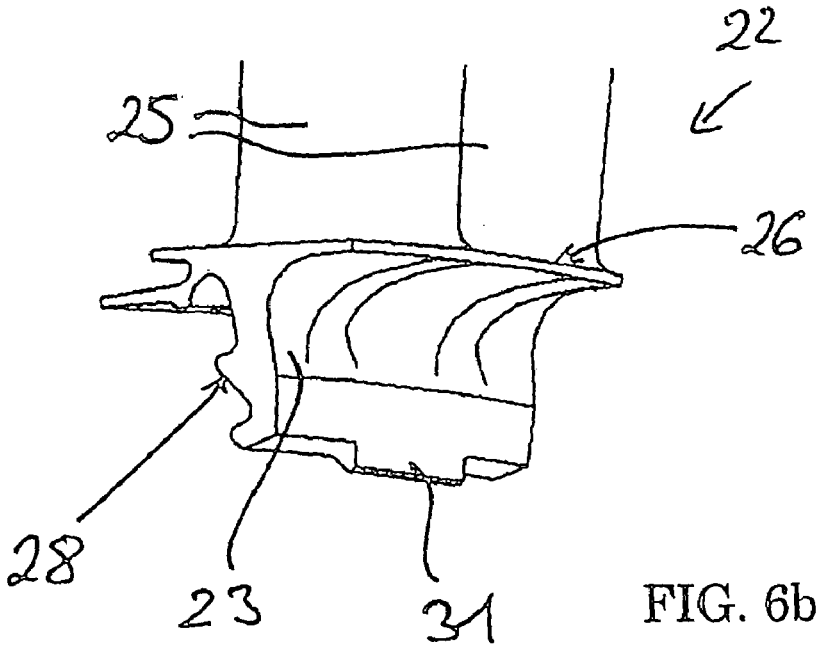

FIG. 2 shows a detail of a gas turbine rotor 20 designed according to the present invention, whereby the gas turbine rotor 20 in the embodiment shown here has a rotor base body 21 and multiple rotor blade segments 22, and the rotor blade segments 22 are anchored in a circumferential groove 24 in the rotor base body 21 with blade bases 23. Each of the rotor blade segments 22 has in addition to the blade base 23, two blades 25, with a platform 26 of the rotor blade segment 22 being designed between the two blades 25 and the blade base 23. FIGS. 6*a* and 6*b* each show such a rotor blade segment 22, illustrated alone in two different perspective views, namely FIG. 6*a* shown in the direction of the so-called admission side of the rotor blade segment 22 and FIG. 6*b* in the direction of the so-called outlet side of same.

Figure 4:
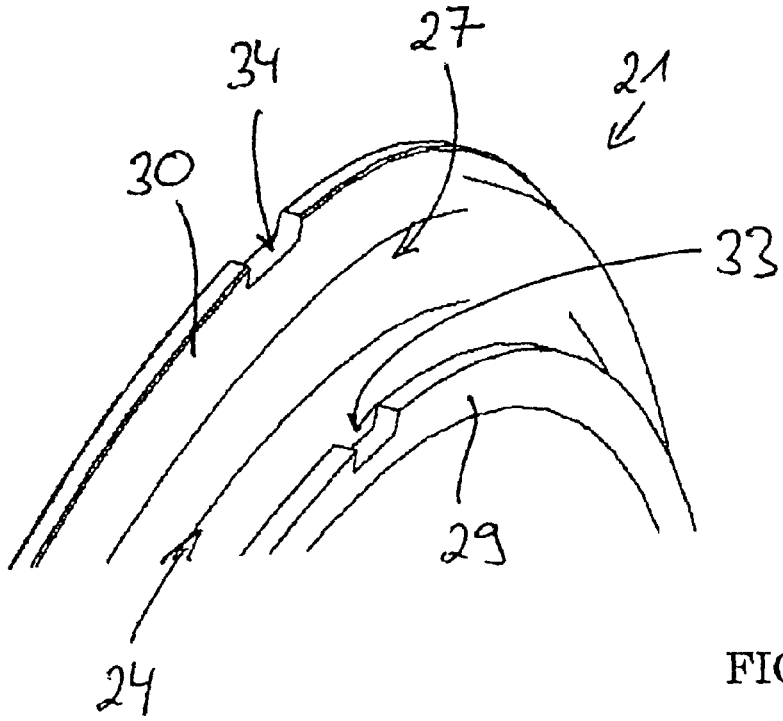
FIG. 4 illustrates a rotor disk of the inventive gas turbine rotor of FIG. 2 in a perspective side view.

In the sense of the present invention, the circumferential groove 24 on the rotor base body 21 has a profiled groove wall leg on only one side by which the blade bases 23 of the rotor blade segments 22 are in contact with supporting flanks 28 having corresponding profiles. The blade bases 23 of the rotor blade segments 22 are thus equipped with profiled supporting flanks 28 on only one side; in the example shown here they have a pine tree shape. On the side opposite the profiled groove wall leg 27, the rotor base body 21 has a circumferential rib 29 which has a much smaller radius than a rib 30 of the profiled groove wall leg 27 which is on the outside radially. FIG. 4 shows the rotor base body 21 of the inventive gas turbine rotor 20, shown in a diagram of the base body alone in a detailed section.

The blade bases 23 of the rotor blade segments 22 are secured in a form-fitting manner in the circumferential groove 24 in the rotor base body 21 by means of projections 31 and 32, whereby the projections 31 and 32 each overlap and are engaged behind one of the two ribs 29 and/or 30. The two projections 31 and 32 on the blade bases 23 of the rotor blade segments 22 are positioned at two different diameters, whereby the projection 32 is situated on a larger diameter than the projection 31. The projection 31 may thus be referred to as a projection that is on the inside radially and the projection 32 may be referred to as a projection of a blade base 23 that is on the outside radially. The projection 31 on the inside radially overlaps with the rib 29 of the rotor base body 21 in the installed state (see FIG. 2). However, the projection 32 that is on the outside radially overlaps with or engages behind the radially outer rib 30 of the profiled groove wall leg 27. The projections 31 and 32 secure the blade bases 23 of the rotor blade segments 22 in their axial position in the circumferential groove 24 on the one hand while also preventing them from tilting.

For assembly and/or threading the blade bases 23 of the rotor blade segments 22 into the circumferential groove 24 in the rotor base body 21, the rotor base body 21 has at least one threading opening; in the exemplary embodiment shown in FIGS. 2 through 6*b*, there are two threading openings 33 and 34 which are arranged at different diameters and in the same circumferential position on the rotor base body 21. In the preferred exemplary embodiment in FIGS. 2 through 6*b*, a threading opening 33 is integrated into the rib 29 and another threading opening 34 is integrated into the rib 30 of the groove wall leg 27. These threading openings 33 and 34 are adapted with regard to their position and dimensions to the projections 31 and 32 on the blade bases 23 of the rotor blade segments 22.

Figure 5:
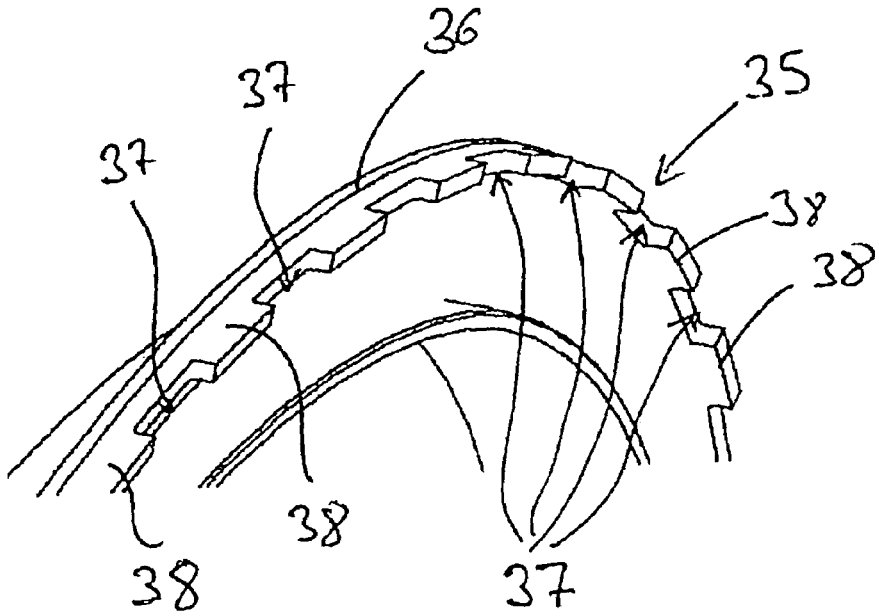
FIG. 5 illustrates a securing element of the inventive gas turbine rotor of FIG. 2 in a perspective side view.

To secure the rotor blade segments 22 which are mounted in the circumferential groove 24 on the rotor base body 21 to also prevent them from being displaced in the circumferential direction, the inventive gas turbine rotor 20 also has a securing element 35. FIG. 5 shows the securing element 35 as a detail in a diagram of that element alone. In the preferred exemplary embodiment, the securing element 35 is designed as a circumferential closed ring having a plurality of recesses 37 on a rib 36 that is on the outside radially. In the installed state, the projections 32 of the blade bases 23 of the rotor blade segments 22 engage in the recesses 37 in the securing element 35 in the sense of gear meshing and thereby secure the rotor blade segments 22 in a form-fitting manner in their circumferential position. The securing element 35 is preferably attached to the rotor base body to secure the relative position between the securing element 35 and the rotor base body 21.

Figure 3A:
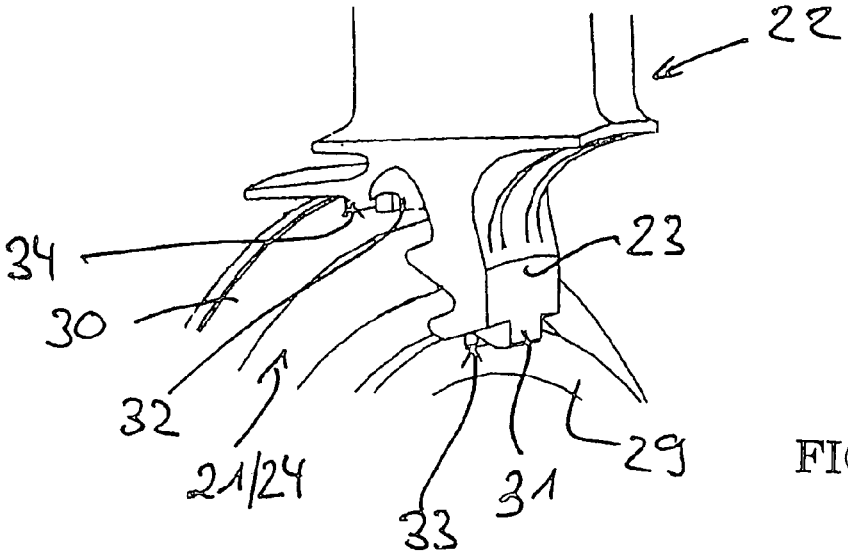
FIGS. 3*a* to 3*i* illustrate the inventive gas turbine rotor of FIG. 2 in various assembly positions from different perspective views.
Figure 3B:
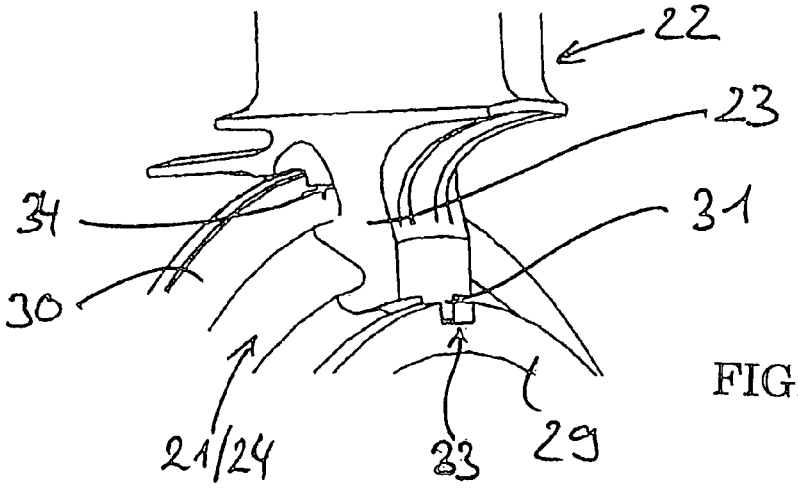
Figure 3C:
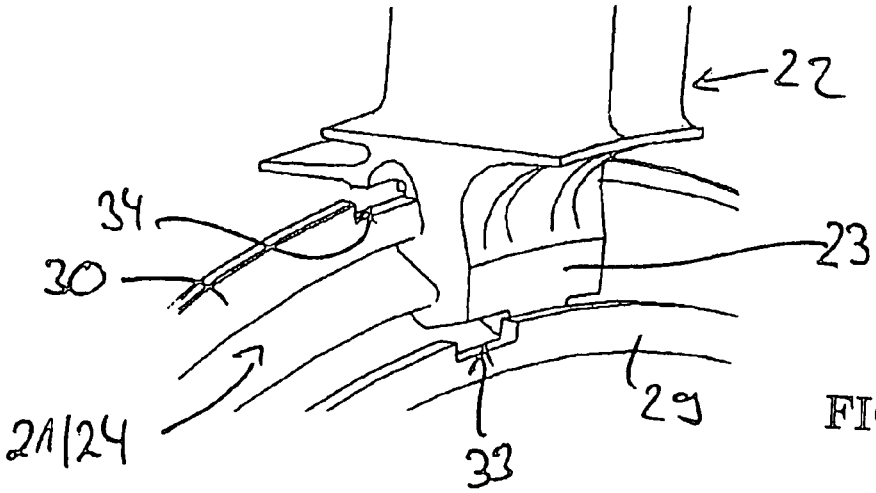
Figure 3D:
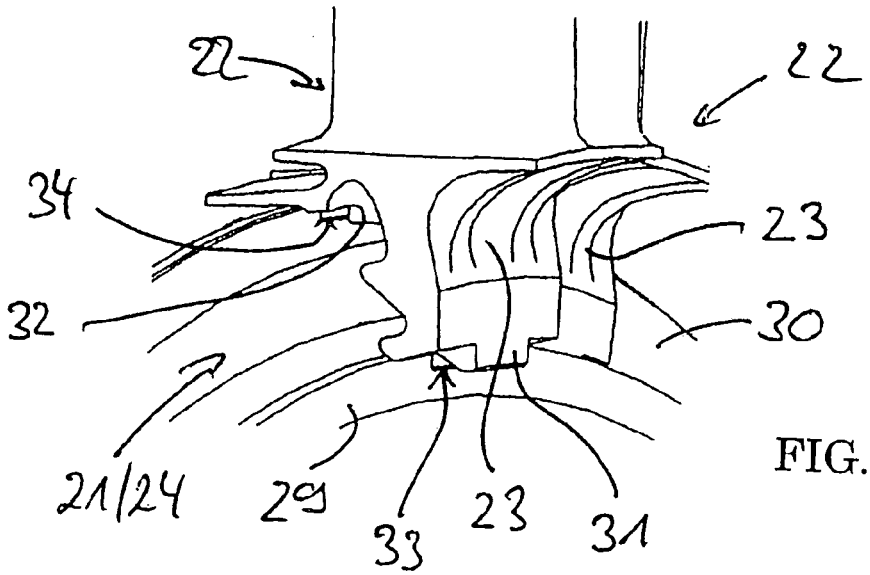
Figure 3E:
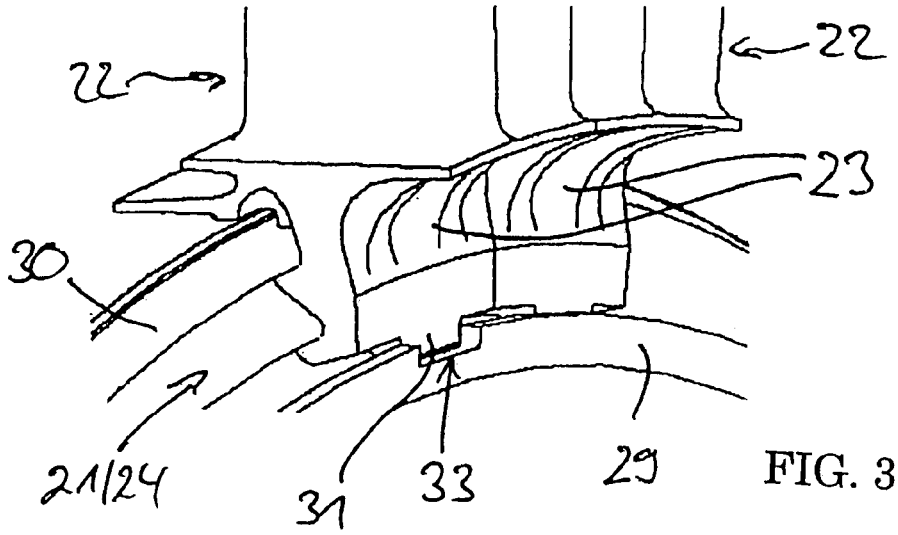
Figure 3F:
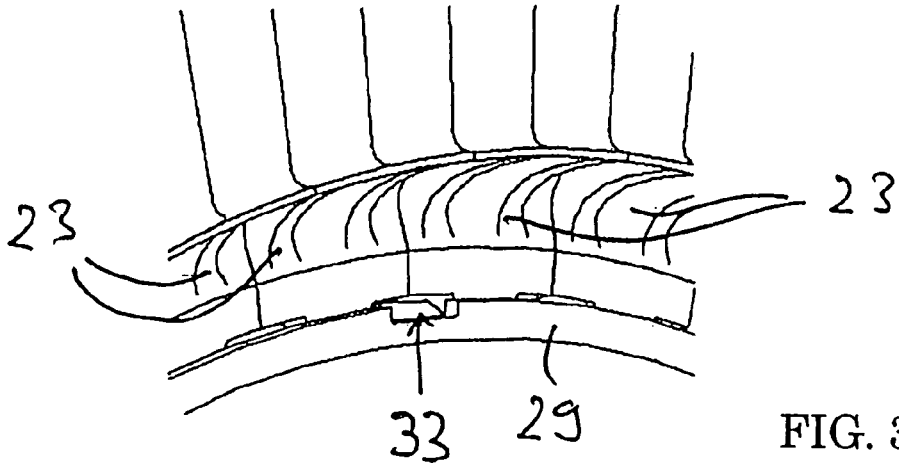
Figure 3G:
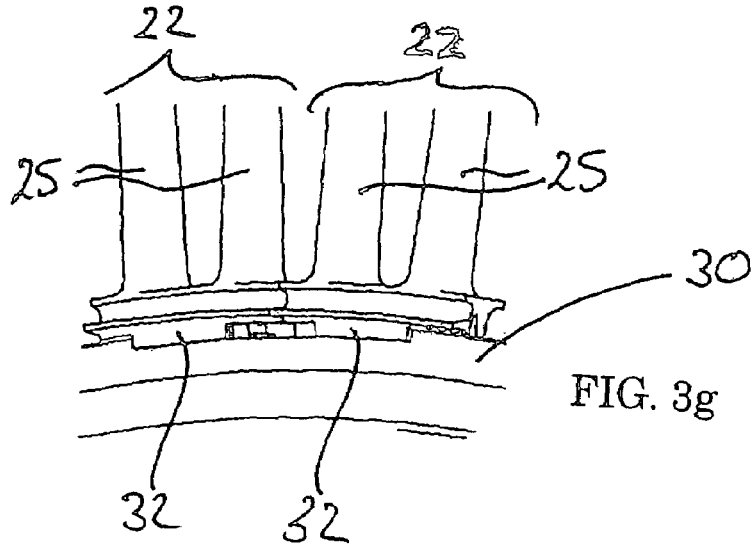
Figure 3H:
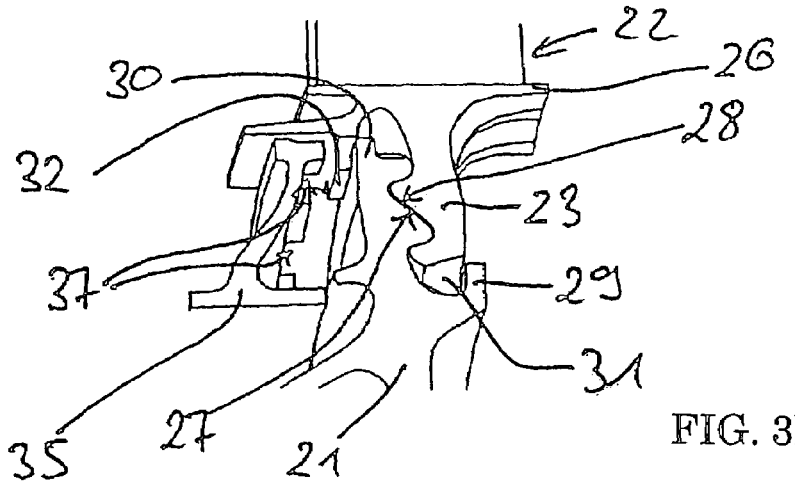
Figure 3I:
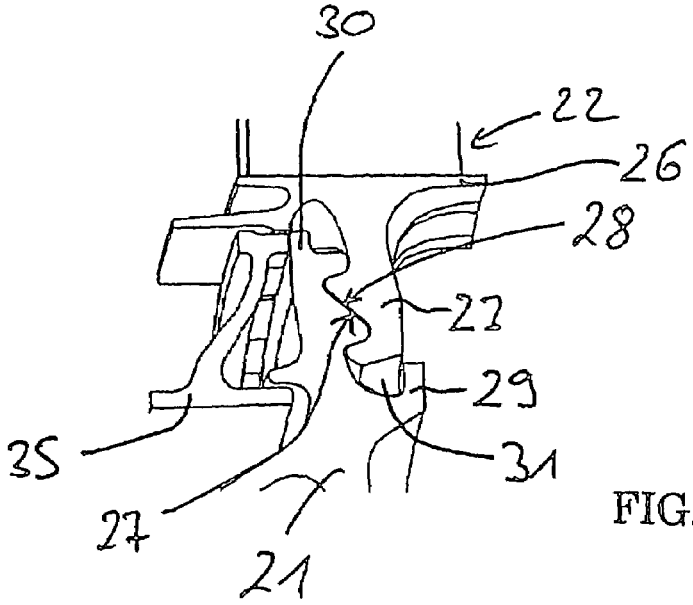

The procedure in assembly of the inventive gas turbine rotor 20, which consists of a plurality of rotor blade segments 22 according to FIGS. 6*a* and 6*b*, a rotor base body 21 according to FIG. 4 and a securing element 35 according to FIG. 5, is described below in greater detail with reference to FIGS. 3*a* through 3*i*. According to FIG. 3*a*, first a rotor base body 21 is provided according to FIG. 4 and a rotor blade segment 22 according to FIGS. 6*a* and 6*b* is also provided, whereby the rotor blade segment 22 has the projections 31 and 32 that are inserted into the threading openings 33 and 34 of the rotor base body 21 in the axial direction in the area of the blade base 23 of the rotor blade segment 22. FIG. 3*a* shows the rotor blade segment 22 before the axial insertion of the same into the circumferential groove 24 on the rotor base body 21. However, FIG. 3*b* shows the rotor blade segment 22 after axial insertion into the circumferential groove 24. After axial insertion of the first rotor blade segment 22 into the circumferential groove 24 of the rotor base body 21, the first rotor blade segment is displaced in the circumferential direction according to FIG. 3*c* to thereby expose the threading openings 33 and 34 for threading the next rotor blade segment 22 into the grooves. Thus FIGS. 3*d* and 3*e* show the threading of the second rotor blade segment 22 into the circumferential groove 24 on the rotor base body 21, whereby again a displacement of the two rotor blade segments in the circumferential direction is performed to fill the circumferential groove 24 successively with rotor blade segments 22. FIG. 3*f* shows a detail of a rotor base body 21 filled with rotor blade segments 22 over the entire circumference in a view of the outlet side of the rotor blade segments 22 and thus the gas turbine rotor 20. FIG. 3*g* shows a view of the admission side therefore. After completely filling the circumferential groove 24 of the rotor base body 21 with rotor blade segments 22, these same segments are also secured in a form-fitting manner in their circumferential position by the securing element 35. FIG. 3*h* thus shows that a securing element 35 is guided from the admission side of the gas turbine rotor 20 up to the rotor base body 21, whereby to secure the circumference of the rotor blade segments 22, the projections 32 that are on the outside radially of the blade bases 23 engage in the recesses 37 in the securing element 35 in the sense of a gear meshing. FIG. 3*i* shows the securing element 35 in the position in which it is meshed with the rotor blade segments 22, whereby the securing element 35 is preferably screwed to the rotor base body 21 to secure the axial position of the securing element 35 in relation to the rotor base body 21. In the preferred exemplary embodiment, the securing element 35 is preferably designed as a sealing ring of a so-called inner air seal gasket.

At this point it should be mentioned that the threading openings 33 and 34 are preferably uniformly distributed over the circumference of the rotor base body 21. Thus the rotor base body 21 may have two or four filling openings 33 positioned on the inside radially and two or four filling openings 34 positioned on the outside radially, the latter being diametrically opposed to the former.

The threading openings 33 and 34 are each integrated into sections of the rotor base body 21 namely into the ribs 29 and 30 thereof, which are exposed to a relatively low level of stress during operation of the gas turbine rotor. The ribs 29 and 30 into which the threading openings 33 and 34 are integrated are thus under only very little load during operation of the gas turbine rotor. This makes it possible for the blade bases 23 to have a width in the circumferential direction which corresponds approximately to a width of the platforms 26 of the rotor blade segments 22. In this way it is possible for the first time to store and/or mount rotor blade segments in circumferential grooves on a gas turbine rotor in a manner that is optimal in terms of both stress and weight.

The threading openings 33 and 34 may either remain open in the installed state of the gas turbine rotor or they may be closed by additional securing elements. It is thus possible to introduce a securing element (not shown here) which ensures an additional circumferential securing effect for the rotor blade segments in the rotor base body, providing this securing element in the threading opening or in each threading opening 33 of the ring 29 which is on the inside radially after completely filling the circumferential groove 24 (see FIG. 3*f*) from the outside of the gas turbine rotor 20. It is also possible that, depending on the number of threading openings 34 that are on the outside radially in the area of the rib 30, some of the projections 38 on the securing element 35 defined by the recesses 37 are extended in the axial direction so that in the installed state they engage in the threading openings 34. This makes it possible to preselect an exact assembly position for the securing element 35.

FIGS. 2 through 6*b* show an exemplary embodiment of an inventive gas turbine rotor 20 in which the rotor base body 21 had threading openings 33 and 34 on two different diameters to thread the blade bases 23 of the rotor blade segments 22 and/or the projections 31 and 32 of the blade bases 23 positioned at different diameter into the circumferential groove 24. In the sense of the present invention, the rotor base body may also have threading openings for the projections on the blade bases at only one diameter.

Figure 7A:
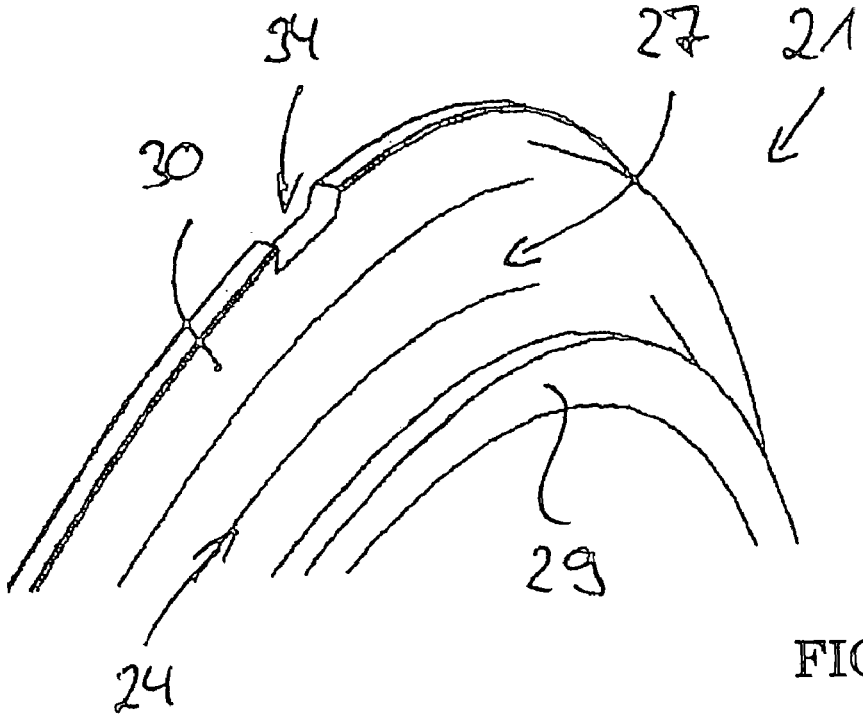
FIGS. 7*a* and 7*b* illustrate a rotor disk and a rotor blade segment of an inventive gas turbine rotor according to a second exemplary embodiment of this invention, each shown in a perspective side view.
Figure 7B:
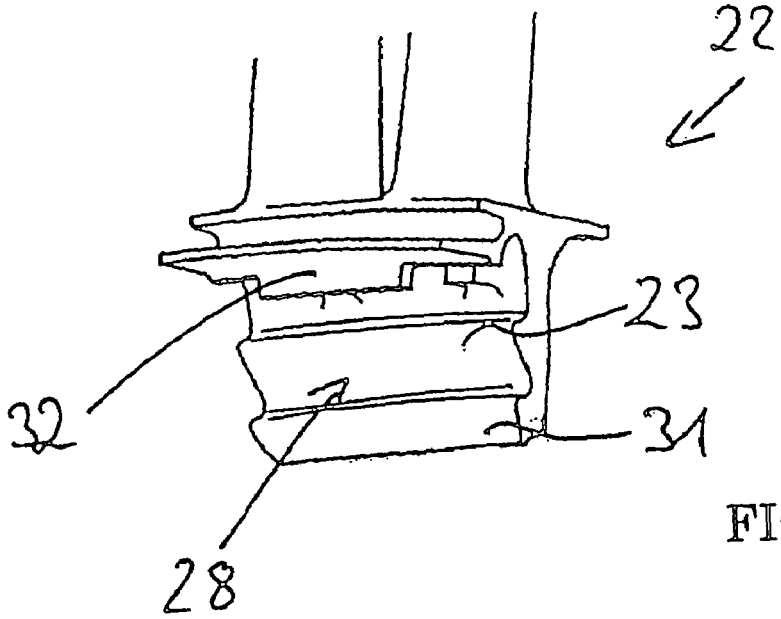

FIG. 7*a* thus shows a rotor base body 21 having a circumferential groove 24, whereby only the rib 30 of the profiled groove wall leg 27 that is on the outside radially, has at least one threading opening 34 for the projection 32 of the blade base 23 of the rotor blade segment 22 that is on the outside radially (see FIG. 7*b*). Several such threading openings 34 may also be integrated into the peripheral rib 30 symmetrically over the circumference. The dimensions of the threading openings 34 on the radially outer rib 30 are then in turn adapted to the dimensions of the projections 32 of the blade bases 23 of the rotor blade segments 22 that are on the outside radially. In this case, the projection 31 of the blade base 23 that is on the inside radially may extend over the entire circumferential extent of the blade base 23. For assembly of the rotor blade segments 22, the procedure followed in the exemplary embodiment in FIGS. 7*a* and 7*b* is such that the rotor blade segments are inserted obliquely into the circumferential groove 24 together with the projections 31 that are on the inside radially and then are pivoted in the direction of the groove wall leg 27 to thereby thread the projection 32 that is on the outside radially through the threading opening 34 in the rib 30 of the groove wall leg 27 that is on the outside radially and thereby thread the rotor segment 22 into the circumferential groove 24 of the rotor base body 21.

Figure 8A:
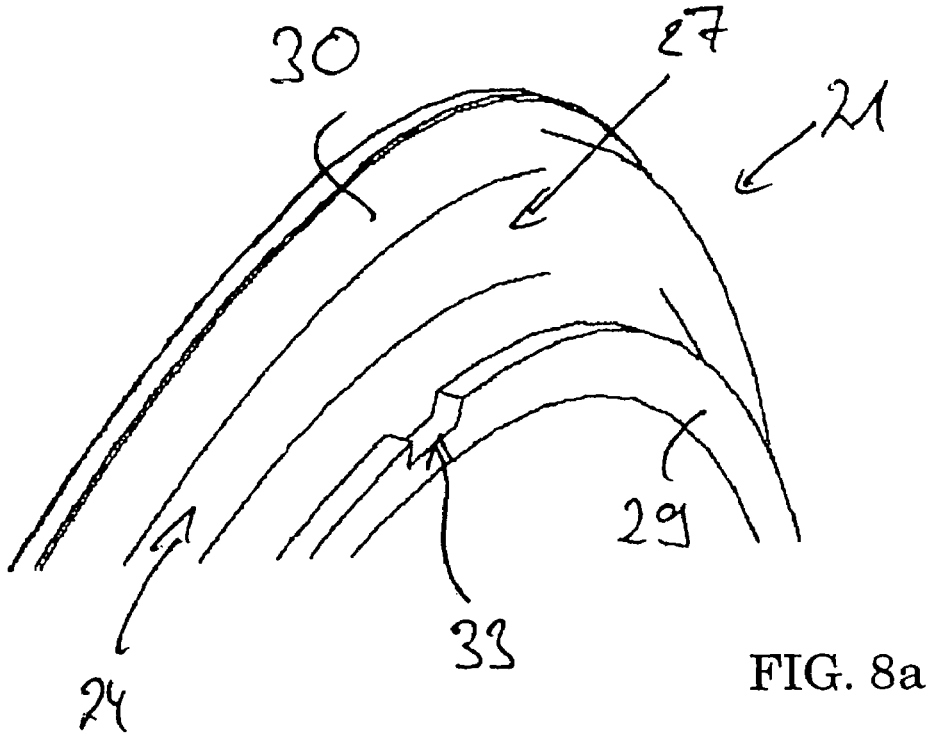
FIGS. 8*a* and 8*b* illustrate a rotor disk and a rotor blade segment of an inventive gas turbine rotor according to a third exemplary embodiment of this invention, each shown in a perspective side view.
Figure 8B:
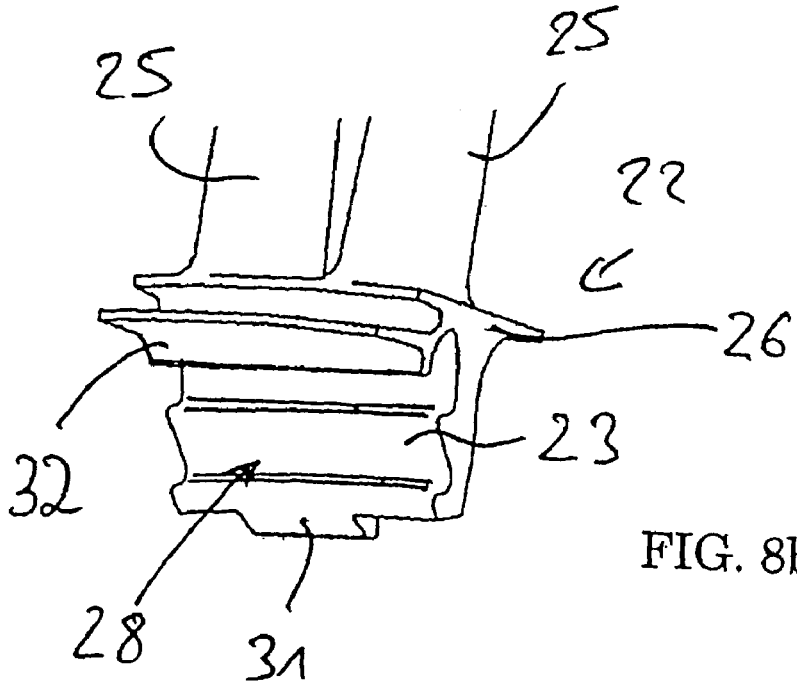

Alternatively, as shown in FIGS. 8*a* and 8*b*, at least one filling opening 33 is provided in the area of the rib 29 of the rotor base body 21 that is on the inside radially, whereas no threading opening is provided in the area of the rib 30 that is on the outside radially of the groove wall leg 27 of the rotor base body 21. In this case, the projection 32 of the blade base 23 of a rotor blade segment 22 that is on the outside radially extends over the entire circumferential dimension of the same, whereby for assembly of the rotor blade segments, they are attached obliquely to the rib 30 that is on the outside radially in the area of the outer projection 32 radially and then pivoted in the direction of the rib 29 into the circumferential groove 24, whereby then the projection 31 on the blade base 23 that is on the inside radially is pivoted through the threading opening 33 that is on the inside radially.

Figure 9:
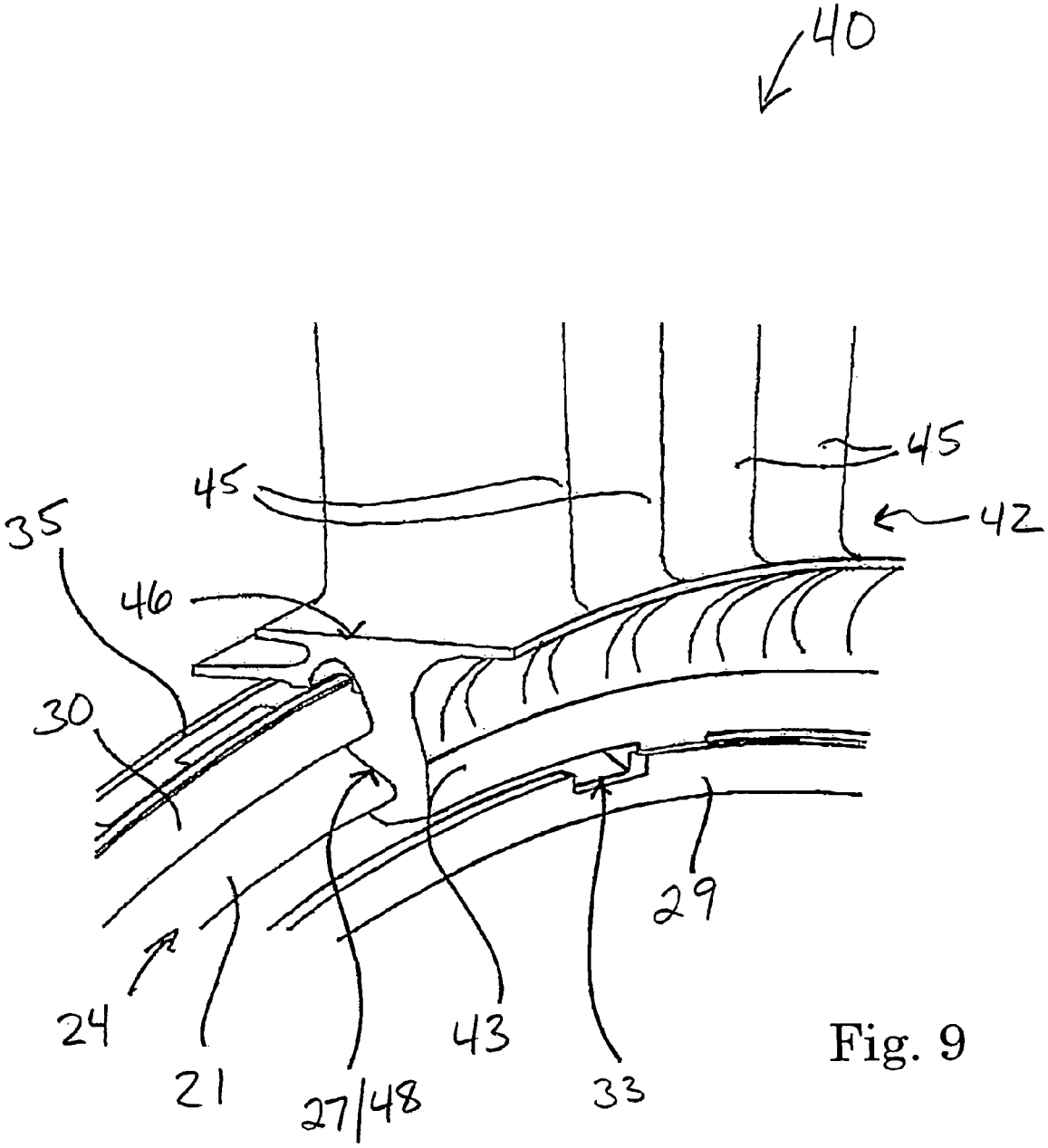
FIG. 9 is a detail of an inventive gas turbine rotor according to a fourth exemplary embodiment of the invention in a perspective side view

FIG. 9 shows a perspective view of a fourth embodiment of the present invention where, instead of rotor blades being included on blade segments, all of the blades 45 of a respective rotor stage are included on an integrally bladed, circumferentially closed rotor blade ring 42. In FIG. 9, the blade ring is shown intersected transversally to show its cross-section in relation to the profiled groove wall leg 27 of the rotor base body 21. This drawing is similar to FIG. 2, however, instead of the blades 25 being included on a plurality of rotor blade segments 22, as can be seen, the blades 45 are included on an integrally bladed, circumferentially closed rotor blade ring 42. For the embodiment of the blade ring 42 of FIG. 9, the same embodiments for the rotor base body, and other components, discussed previously, can be used. Therefore, in FIG. 9, the same reference numerals are used for the rotor base body as were used in the prior discussion.

Thus, FIG. 9 shows a detail of a gas turbine rotor 40 designed according to the fourth embodiment of the present invention, whereby the gas turbine rotor 40 in the embodiment shown here has the rotor base body 21 and an integrally bladed, circumferentially closed rotor blade ring 42 with blades 45. The single rotor blade ring 42 is anchored in the circumferential groove 24 in the rotor base body 21 with a ring base 43. The rotor blade ring 42 has in addition to the ring base 43, blades 45, with a platform 46 of the rotor blade ring 42 being designed between the blades 45 and the ring base 43.

As in the previous embodiments, the circumferential groove 24 on the rotor base body 21 has a profiled groove wall leg on only one side by which the ring base 43 of the rotor blade ring 42 is in contact with a supporting flank 48 having a corresponding profile. The ring base 43 of the rotor blade ring 42 is also thus equipped with a profiled supporting flank 48 on only one side; which in the example shown here is a pine tree shape. As previously described, on the side opposite the profiled groove wall leg 27, the rotor base body 21 has the circumferential rib 29 which has a much smaller radius than the rib 30 of the profiled groove wall leg 27 which is on the outside radially. As also discussed previously, FIG. 4 shows the rotor base body 21 of the inventive gas turbine rotor, shown in a diagram of the base body alone in a detailed section.

In the same way that the blade bases 23 of the rotor blade segments 22 were secured in a form-fitting manner in the circumferential groove 24 in the rotor base body 21 by means of projections 31 and 32, whereby the projections 31 and 32 each overlap and are engaged behind one of the two ribs 29 and/or 30, ring base 43 of rotor blade ring 42 also includes these projections and these projections engage in the same manner as projections 31 and 32 of the previous embodiment. These two projections on the ring base 43 of the rotor blade ring 42 are also positioned at two different diameters, whereby the projection which corresponds to projection 32 is situated on a larger diameter than the projection which corresponds to projection 31. Thus, the projections on the ring base secure the ring base 43 of the rotor blade ring 42 in its axial position in the circumferential groove 24 on the one hand while also preventing it from tilting. The ring base may include any number of projections on the two diameters, and accordingly, the rotor base body would include a corresponding number of threading openings.

As can be understood, the ring base 43 is installed in the rotor base body 21 in a manner similar to the way that the rotor blade segments 22 were installed, whereby the projections are inserted into the threading openings 33 and 34 of the rotor base body 21 in the axial direction. Thus, the bladed ring 42 is installed like the blades or blade segments by first moving it axially into the groove 24 of the rotor base body 21, then turning it circumferentially around the rotor axis over a defined angle within the groove for securing it against axial movement and tilting and finally locking it against circumferential movement by form-fitting means, e.g., by securing element 35.

Further with this embodiment, as per the prior discussion, the rotor base body may be configured in alternative embodiments. For example, the threading openings 33 and 34 may be uniformly distributed over the circumference of the rotor base body 21. Alternatively, the rotor base body may be configured similar to the embodiments of FIGS. 7*a* and 8*a*. For these alternative embodiments for the rotor base body, as can be understood by one skilled in the art, the respective projections on the ring base would be configured as described for the blade bases of the blade segments of FIGS. 7*b* and 8*b* and the rotor blade ring would be installed as described for these blade segments. Again, for these alternative embodiments for the rotor base body, the ring base may include any number of projections on the respective diameters, and accordingly, the rotor base body would include a corresponding number of threading openings.

The inventive principle of a gas turbine rotor is especially advantageous in mounting rotor blade segments in a circumferential groove on a rotor base body of the gas turbine rotor. However, it is also possible in the matter according to this invention to mount individual blades or an integrally bladed, circumferentially closed rotor blade ring in a circumferential groove on a gas turbine rotor. In the circumferential direction, a width of the blade base of the rotor blades or the rotor blade segments, or the ring base of the rotor blade ring, corresponds approximately to a width of a platform(s) of the same. In the case, e.g., of rotor blades and/or rotor blade segments having outer cover bands, the Z latching known from the state of the art can be omitted, which results in a simplified assembly for a gas turbine rotor.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

LIST OF REFERENCE NUMERALS

10 Gas turbine rotor
11 Rotor base body
12 Rotor blade
13 Blade
14 Blade base
15 Blade platform
16 Groove
17 Groove wall leg
18 Groove wall leg
19 Notching
20 Gas turbine rotor
21 Rotor base body
22 Rotor blade segment
23 Blade base
24 Circumferential groove
25 Blade
26 Platform
27 Groove wall leg
28 Supporting flank
29 Rib
30 Rib
31 Projection
32 Projection
33 Threading opening
34 Threading opening
35 Securing element
36 Rib
37 Recess
38 Projection
40 Gas turbine rotor
42 Rotor blade ring
43 Ring base
45 Blade
46 Platform
48 Supporting flank

What is claimed is:

1. A rotor of a turbine-type machine, in particular a gas turbine rotor, having a rotor base body, wherein the rotor base body has a groove extending in a circumferential direction of the rotor base body, and having an integrally bladed, circumferentially closed rotor blade ring, wherein the rotor blade ring is anchored by a ring base in the groove of the rotor base body, wherein the groove has a profiled groove wall leg on only one side and wherein a profiled supporting flank of the ring base of the rotor blade ring is in contact with the groove wall leg, and wherein the groove and/or the rotor base body has at least one threading opening for a projection of the ring base on at least one diameter.

2. The rotor according to claim 1, wherein a width of the ring base corresponds approximately to a width of a platform of the rotor blade ring in the circumferential direction.

3. The rotor according to claim 1, wherein the ring base of the rotor blade ring has at least one projection on at least two different diameters, with the projections securing the ring base in the groove in a form-fitting manner.

4. The rotor according to claim 3, wherein the projections positioned on different diameters are arranged in approximately a same circumferential position.

5. The rotor according to claim 3, wherein at least one securing element cooperates with the projections on the ring base, wherein the securing element or each securing element secures the rotor blade ring in the groove in a circumferential position.

6. The rotor according to claim 5, wherein the securing element or each securing element has multiple recesses wherein the projections on the ring base that are positioned on an outside radially engage in the recesses in the securing element to provide a form-fitting means of securing the circumferential position of the rotor blade ring.

7. The rotor according to claim 5, wherein the securing element or each securing element is attached to the rotor base body.

8. The rotor according to claim 1, wherein the ring base has at least one projection extending radially inward on two different diameters, wherein the projections secure the rotor blade ring in the groove in an axial position and against tilting.

9. The rotor according to claim 1, wherein the groove and/or the rotor base body has at least one threading opening for a projection of the ring base on two different diameters.

10. The rotor according to claim 9, wherein the threading openings which are positioned at different diameters are arranged approximately in a same circumferential position.

11. The rotor according to claim 1, wherein the threading opening or each threading opening is integrated into a rib and/or a portion of the rotor base body which is exposed to a relatively low tension level during operation.

12. The rotor according to claim 1, wherein the supporting flank is profiled like a pine tree on only one side facing the profiled groove wall leg of the groove.

13. A gas turbine, in particular an aircraft jet engine, having at least one rotor according to claim 1.

14. A rotor of a turbine-type machine, in particular a gas turbine rotor, having a rotor base body, wherein the rotor base body has a groove extending in a circumferential direction of the rotor base body, and having an integrally bladed, circumferentially closed rotor blade ring, wherein the rotor blade ring is anchored by a ring base in the groove of the rotor base body, wherein the groove has a profiled groove wall leg on only one side and wherein a profiled supporting flank of the ring base of the rotor blade ring is in contact with the groove wall leg;

wherein the ring base of the rotor blade ring has at least one projection on at least two different diameters, with the projections securing the ring base in the groove in a form-fitting manner; and wherein the projections partially overlap and/or engage a corresponding rib of the rotor base body.

15. A rotor of a turbine-type machine, comprising:

a rotor base body, wherein a groove is defined between a profiled wall leg of the rotor base body and an unprofiled rib of the rotor base body and wherein the groove extends in a circumferential direction of the rotor base body; and an integrally bladed and circumferentially closed rotor blade ring having a ring base, wherein the ring base includes a profiled supporting flank;

wherein the ring base is secured in the groove with the profiled wall leg of the rotor base body contacting the profiled supporting flank of the ring base and wherein the groove and/or the rotor base body has at least one threading opening for a projection of the ring base on at least one diameter.

16. The rotor according to claim 15, wherein the rotor blade ring further includes a platform and wherein the ring base is attached to the platform and further wherein a width of the ring base in the circumferential direction is approximately equal to a width of the platform in the circumferential direction.

17. The rotor according to claim 15, wherein the ring base includes a second projection and wherein the projection extends radially inward at a first radial distance on the ring base and the second projection extends radially inward at a second radial distance on the ring base.

18. A rotor of a turbine-type machine, comprising:

a rotor base body, wherein a groove is defined between a profiled wall leg of the rotor base body and an unprofiled rib of the rotor base body and wherein the groove extends in a circumferential direction of the rotor base body; and an integrally bladed and circumferentially closed rotor blade ring having a ring base, wherein the ring base includes a profiled supporting flank;

wherein the ring base is secured in the groove with the profiled wall leg of the rotor base body contacting the profiled supporting flank of the ring base;

wherein the ring base includes a first projection extending radially inward at a first radial distance on the ring base and a second projection extending radially inward at a second radial distance on the ring base; and wherein the rotor base body includes a second unprofiled rib on the profiled wall leg and wherein the first projection engages with the unprofiled rib and the second projection engages with the second unprofiled rib.

19. A method for securing an integrally bladed and circumferentially closed rotor blade ring of a turbine-type machine to a rotor base body, wherein a groove is defined between a profiled wall leg of the rotor base body and an unprofiled rib of the rotor base body, wherein the groove extends in a circumferential direction of the rotor base body, wherein the groove and/or the rotor base body has at least one threading opening on at least one diameter, and further wherein the rotor blade ring has a ring base that includes a profiled supporting flank, comprising the steps of:

placing a projection of the ring base through the at least one threading opening;

placing the ring base in the groove of the rotor base body; and engaging the profiled supporting flank of the ring base with the profiled wall leg of the rotor base body.

20. The method according to claim 19:

wherein the rotor base body includes a second unprofiled rib on the profiled wall leg;

wherein the ring base includes a second projection and wherein the projection extends radially inward at a first radial distance on the ring base and the second projection extends radially inward at a second radial distance on the ring base;

and further comprising the steps of engaging the projection with the unprofiled rib and engaging the second projection with the second unprofiled rib.

* * * * *